United States Patent [19]

Suzuki

[11] Patent Number: 4,635,750

[45] Date of Patent: Jan. 13, 1987

[54] LOUDSPEAKER DIAPHRAGM

[75] Inventor: Akihisa Suzuki, Higashihiroshima, Japan

[73] Assignee: Sharp Kabushiki Kaisha, Osaka, Japan

[21] Appl. No.: 740,545

[22] Filed: Jun. 3, 1985

[51] Int. Cl.[4] ..... G10K 13/00

[52] U.S. Cl. ..... 381/194; 181/171; 381/204

[58] Field of Search ..... 181/161, 169, 171, 173, 181/DIG. 1; 179/115.5 R, 115.5 PC, 119 R, 181 E

[56] References Cited

U.S. PATENT DOCUMENTS

| | | | |
|---|---|---|---|
| 1,920,299 | 8/1933 | Fanger | 181/171 X |
| 3,172,498 | 3/1965 | Gorike | 181/DIG. 1 X |
| 4,132,872 | 1/1979 | Inoue | 179/115.5 R |
| 4,184,563 | 1/1980 | Bertagnn | 181/171 |
| 4,275,278 | 6/1981 | Sakurai et al. | 179/181 F |
| 4,327,257 | 4/1982 | Schwartz | 181/171 X |
| 4,384,174 | 5/1983 | Suzuki et al. | 181/171 X |

*Primary Examiner*—Benjamin R. Fuller

*Attorney, Agent, or Firm*—Flehr, Hohbach, Test, Albritton & Herbert

[57] ABSTRACT

A loudspeaker diaphragm has a step near the middle of its back surface. This makes it easier to attach a bobbin correctly and the production efficiency can be improved.

3 Claims, 4 Drawing Figures

LOUDSPEAKER DIAPHRAGM

This invention relates to an improved diaphragm for a plane-type loudspeaker.

There have been plane-type loudspeakers which use the frame and magnetic circuit of a cone-type loudspeaker but the front surface of which is made planar by using a foam material to fill the space where a cone-shaped diaphragm would be. An example of such plane-type loudspeaker is illustrated in FIG. 1 wherein a field system section 5 comprising a plate 2 with a center pole 1, an annular magnet 3 made of ferrite and an annular plate 4 is connected to a frame 6, and an edge piece 7 and the peripheral section of a diaphragm 8 shaped like a frustum of a cone and filled with a foam material are connected to the periphery of this frame 6. There is a bobbin 9 connected to this diaphragm 8 in the middle section on the backside, and this bobbin 9 is supported at the center by a damper 11 so that it is correctly positioned with respect to the magnetic gap 12 of the field system section 5 of a voice coil.

It is very difficult, however, to install the bobbin 9 accurately at the center of the back surface of the diaphragm 8. For this reason, it was necessary, for example, to use an apparatus 13 shown in FIG. 2 having an inner diameter which is identical to the outer diameter of the diaphragm 8 and a protruding section 13*a* which is slightly larger than the center pole. When the diaphragm 8 and the bobbin 9 are attached together, they are placed inside this apparatus 13 for drying. This method is time-consuming and production efficiency could not be improved easily.

It is therefore an object of this invention to eliminate the problem explained above by providing a diaphragm which can be easily attached to a bobbin. The above and other objects of this invention are attained by providing a plane-type or cone-type diaphragm with a foam material in the shape of a frustum of a cone, having a step near the center of the back surface for positioning the bobbin.

Figure 1:
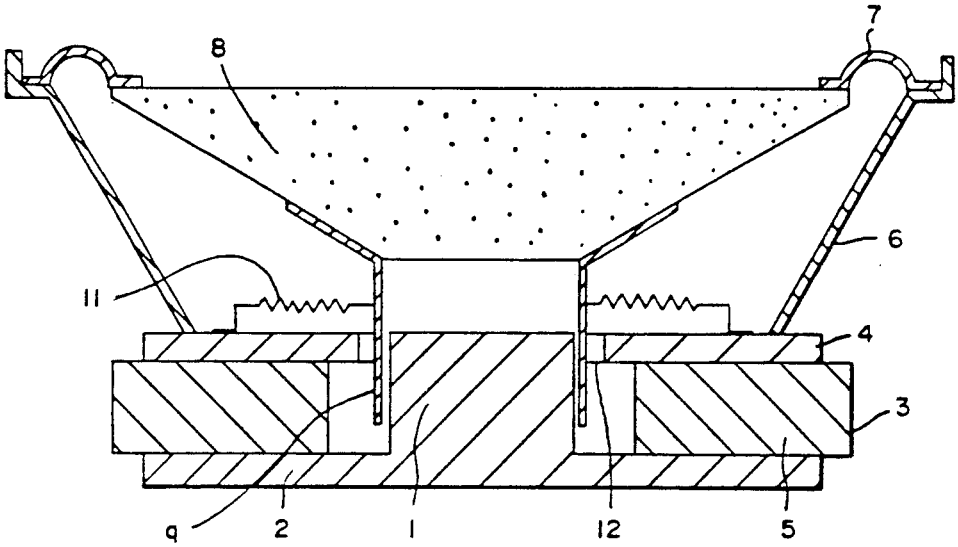
PRIOR ART FIG.—1
FIG. 1 is a cross-sectional view of a conventional loudspeaker.
Figure 2:
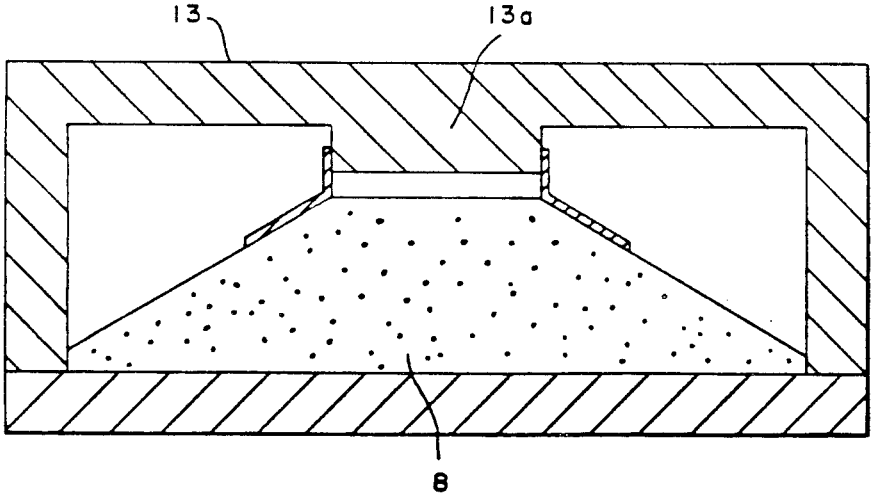
PRIOR ART FIG.—2
FIG. 2 is a cross-sectional view of an apparatus for a conventional loudspeaker.
Figure 3:
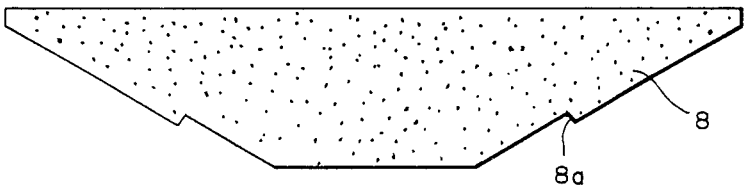
FIGS. 3 and 4 are cross-sectional views of a loudspeaker diaphragm according to the present invention.
Figure 4:
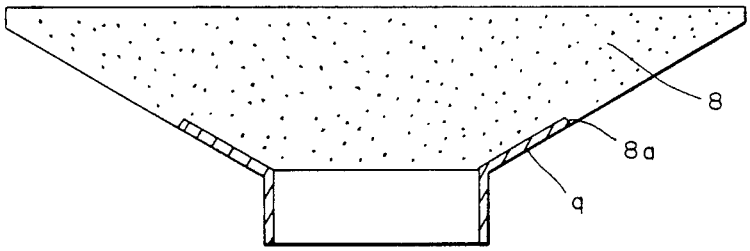

In FIG. 3, numeral 8 indicates a diaphragm in the shape of a frustum of a cone filled with a foam material. The diaphragm 8 has an inward step 8*a* about the thickness of the bobbin 9 near the middle of its back surface so that, as shown in FIG. 4, the position at which the bobbin 9 should be attached can be determined easily. The work of attaching the bobbin becomes easier and the production time can be made shorter than by using an apparatus of FIG. 2.

The present invention was described above in terms of only one example but it should be understood that many variations and modifications can be made within the spirit of this invention. For example, although a plane-type diaphragm was considered above, it should be considered also within the scope of the present invention if a foam material is formed into the shape of a cone and a step is created near the middle of its back part. The scope of this invention is limited only by the following claims.

What is claimed is:

1. A plane-type or cone-type loudspeaker diaphragm with a foam material having an inclined surface formed to shape a frustum of a cone, said cone having an inward step provided therein about the thickness of a bobbin near the middle of the inclined surface such that the bobbin for accurately positioning said diaphragm with respect to a voice coil can be easily attached to said diaphragm correctly.

2. The diaphragm of claim 1 wherein said bobbin is generally shaped conically.

3. The diaphragm of claim 2 having a back surface which is generally shaped conically.

* * * * *